US005474238A

United States Patent [19]

Reichmuth

[11] Patent Number: 5,474,238

[45] Date of Patent: Dec. 12, 1995

[54] IMPACT DETACHER

[75] Inventor: Franz Reichmuth, Flawil, Switzerland

[73] Assignee: Buehler AG, Uzwil, Switzerland

[21] Appl. No.: 316,377

[22] Filed: Sep. 30, 1994

Related U.S. Application Data

[63] Continuation of Ser. No. 115,452, Sep. 1, 1993, abandoned, which is a continuation of Ser. No. 741,414, filed as PCT/CH90/00278, Dec. 4, 1990, abandoned.

[30] Foreign Application Priority Data

Jan. 31, 1990 [CH] Switzerland ..... 00311/90

[51] Int. Cl.[6] ..... B02C 9/00

[52] U.S. Cl. ..... 241/47; 241/188.2; 241/275

[58] Field of Search ..... 241/47, 188.2, 241/275

[56] References Cited

U.S. PATENT DOCUMENTS

| | | | |
|---|---|---|---|
| 2,191,095 | 2/1940 | Hobbie | 241/275 X |
| 2,928,616 | 3/1960 | Smith | 241/275 |
| 3,102,781 | 9/1963 | Hoskins et al. | 241/188.2 X |
| 3,180,582 | 4/1965 | Danyluke | 241/275 |
| 3,684,198 | 8/1972 | Pallmann | 241/275 X |

FOREIGN PATENT DOCUMENTS

| | | | |
|---|---|---|---|
| 0521349 | 3/1931 | Germany . | |
| 0591968 | 1/1934 | Germany . | |
| 923169 | 2/1955 | Germany . | |
| 1026159 | 3/1958 | Germany . | |
| 1253562 | 11/1967 | Germany . | |
| 1814751 | 6/1970 | Germany . | |
| 2802856 | 7/1979 | Germany | 241/188 R |
| 0168387 | 8/1959 | Sweden . | |
| 0491674 | 7/1970 | Switzerland . | |
| 0573189 | 9/1977 | U.S.S.R. | 241/188 R |
| 1281299 | 1/1987 | U.S.S.R. | 241/275 |
| 1412810 | 7/1988 | U.S.S.R. | 241/275 |
| 0539883 | 9/1941 | United Kingdom . | |
| 1013610 | 12/1965 | United Kingdom . | |

*Primary Examiner*—Eugenia Jones

*Attorney, Agent, or Firm*—Finnegan, Henderson, Farabow, Garrett & Dunner

[57] ABSTRACT

An impact detacher with a centrifugal wheel and two or more centrifugal conduits which are enclosed by two or more impact rings, wherein the material to be ground is fed concentrically via a feed pipe and guided away again via an outer annular conduit. Each half of the impact ring is directed to two oppositely directed impact surfaces, wherein the impact detacher can comprise a common product discharge conduit. The centrifugal wheel comprises a guiding apparatus with a divided feed in the area of the product inlet, wherein a larger feed surface is assigned to the centrifugal conduit remote of the feed pipe.

17 Claims, 5 Drawing Sheets

IMPACT DETACHER

This application is a continuation of application Ser. No. 08/115,452, filed Sep. 1, 1993, now abandoned, which is a continuation of prior application Ser. No. 07/741,414, filed as PCT/CH90/00278, Dec. 4, 1990, now abandoned.

BACKGROUND OF THE INVENTION a) Technical Field

The invention is directed to an impact detacher for grain-, semolina- or flour-type materials, comprising a rotating centrifugal wheel which is enclosed by an impact ring and comprises a concentric feed pipe as well as an annular discharge conduit.

b) Background Art

Different types of impact machines are used in mills and in mill-type grinding. Depending on their use, they are designated as impact detachers, sterilizers and, in the English speaking world, as entoleters. With respect to process technology, the processes are either identical or similar. The impact force or impact velocity exerted on the product is adapted to the case of application.

The individual parts of the materials have a very great strength, whether it be the grain kernel as a whole or the semolina or flour parts. On the other hand, a grain kernel which has been hollowed out by a grain weevil, for example, is fragile. Insects and insect eggs are very sensitive to impact. This fact is made use of in impacting in that e.g. hollow kernels are broken up and insects and insect eggs are killed with the impact machine designated as a sterilizer.

Another substantial aim of the mill is the separation of the endosperm layer from the white flour kernel. The ground material proceeding from a roller mill is divided into the desired fractions in the subsequent plan sifter. When the impact detacher is used diagrammatically between the roller mill and the plan sifter, the flakes occurring during the grinding are detached and adhering endosperm particles are loosened.

In a great many cases of application, the specifically selected geometrical relationships with an optimal circumferential speed of the centrifugal wheel allow a very good effect for the desired work results. Recently, in particular, this type of processing and the prevention of the destruction of the basic foodstuff, without the use of any disadvantageous thermal process or radiation effects whose action has never been sufficiently explained, is generally desired. This is the desired mechanical operation with the possibility of separating the fractions in an exclusively mechanical manner. Therefore, one of the main objects of the invention was to improve the mechanical solution in this respect.

The chief disadvantage of the previously known solutions consists in that the desired effect is reduced in inverse proportion to the product throughput as the product throughput through the impact machine increases, combined with the very unpleasant fact that the killing of destructive insects is not noticed immediately. It is also not easy to determine whether the impact separation of endosperm and flour particles is carried out in an optimal manner. As a result, it became a widespread belief in technical circles that impact machines would be of little value. In fact, this could also be proved with practical tests in particular cases. However, it also had to be admitted usually that the individual impact machines were loaded beyond the allowable throughput quantities.

SUMMARY OF THE INVENTION

A primary object of the invention is to improve the impact machine in order to make possible a genuine increase in throughput while nevertheless maintaining the work quality and an effectiveness of virtually 100%, with respect both to eliminating destructive insects and separating the endosperm from the husk.

The new invention is characterized in that the centrifugal wheel comprises at least two axially offset centrifugal conduits.

Only with the present invention has it been realized that previously too little attention was paid to the product flow or product flows on the one hand and to the situation at the location of impacting on the other hand. As the result of an excessive concentration of the product flow, a product cushion, as it were, is built up over the impact surfaces with a part of the product flow, so that the impact is dampened in this manner and there is no longer adequate striking force e.g. for crushing hollow grains or insect eggs. In the latter case, the product flow undergoes a disruptive deflection, either because too much product flows through in certain areas or because too little product flows through in other areas. The impact detacher is a difficult machine to the extent that a mixture is processed. The laws of air flow in the sense of a ventilator apply, but also the physical laws of a product centrifuge. Therefore, for obvious reasons a direct comparison of the compressed flow centrifuge with a water or air model has previously been avoided, since extreme separations occur in the centrifugal wheel due to sharp deflection and acceleration of the product. The guiding of the product can be mastered only by means of using more than one centrifugal conduit in one machine.

Tests have shown that the product throughput can actually be doubled in this manner with only a slight extra expenditure on construction and with the same efficiency of impact. Surprisingly, the new invention allows a whole range of particularly advantageous developments in addition.

For example, it is particularly preferred to arrange a guiding apparatus in the centrifugal wheel subsequent to the feed pipe so as to be securely connected with the centrifugal wheel and so as to rotate along with it. The guiding apparatus comprises a plurality of feed conduits which are guided up to the centrifugal conduits which are shaped like annular disks.

When the centrifugal conduits are axially offset, various shapes of feed conduits are formed in a compulsory manner. In this case also, a great number of tests have shown that a plurality of feed conduits is necessary in the case of two axially offset centrifugal conduits, wherein twice the number of feed conduits are to be assigned to the centrifugal conduit remote of the feed pipe in proportion to the number of feed conduits for the centrifugal conduit near the feed pipe. Or, respectively, a corresponding surface ratio for the feed is to be maintained. This resulted in an exact halving of the product for the two centrifugal conduits and the two centrifugal conduits provide identical centrifugal conditions for the product.

A further advantage consists in that the feed conduits opening into the centrifugal conduit remote of the feed pipe comprise at the outer circumference an installation which reduces the cross section. The installation is constructed as an annular portion with tapered shape toward the axis of rotation.

The feed conduits which are identical to one another are positioned in a symmetrical manner. In another, preferred design idea a separate annular impact surface is assigned to every centrifugal conduit.

The impacting works in an optimal manner when the centrifugal wheel is constructed as a double wheel and the impact ring comprises two oppositely directed impact surfaces; a reciprocal product discharge conduit which opens into a tangential product discharge conduit is preferably assigned to the double wheel and the two impact surfaces.

In this preferred construction, the impact surfaces are constructed, with reference to the double wheel, as two truncated cones which open in opposite directions. For the purpose of self-cleaning as well as the impact effect, the guiding apparatus comprises flat guiding blades.

In a continuation of the inventive idea, it is further possible to realize a centrifugal wheel with three or four axially offset centrifugal conduits, wherein the farther the centrifugal conduit, as seen from the feed, the greater the number of feed conduits which should open into the latter or the corresponding feed surface to be adapted, respectively. A separate impact ring is preferably assigned to every centrifugal conduit.

The cost in construction can be kept very low by flanging on an electric drive motor directly to the housing of the impact detacher. The centrifugal wheel then has the same number of revolutions per minute as the electric motor, e.g. 3000 r.p.m.

The product discharge conduit can be formed from two halves of approximately identical shape which can be divided in a vertical plane relative to the axis of rotation of the shaft of the centrifugal wheel.

The impact detacher is advantageously formed in the manner of a ventilator, so that the product feed and product discharge can be selected in both a vertical and horizontal plane in all spatial directions.

This allows almost complete freedom with respect to the installation in a processing operation and facilitates the corresponding planning of a plant.

For a better understanding of the present invention, reference is made to the following description and accompanying drawings while the scope of the invention will be pointed out in the appended claims.

DETAILED DESCRIPTION OF THE INVENTION, PREFERRED EMBODIMENTS AND BEST MODE

Figure 1:
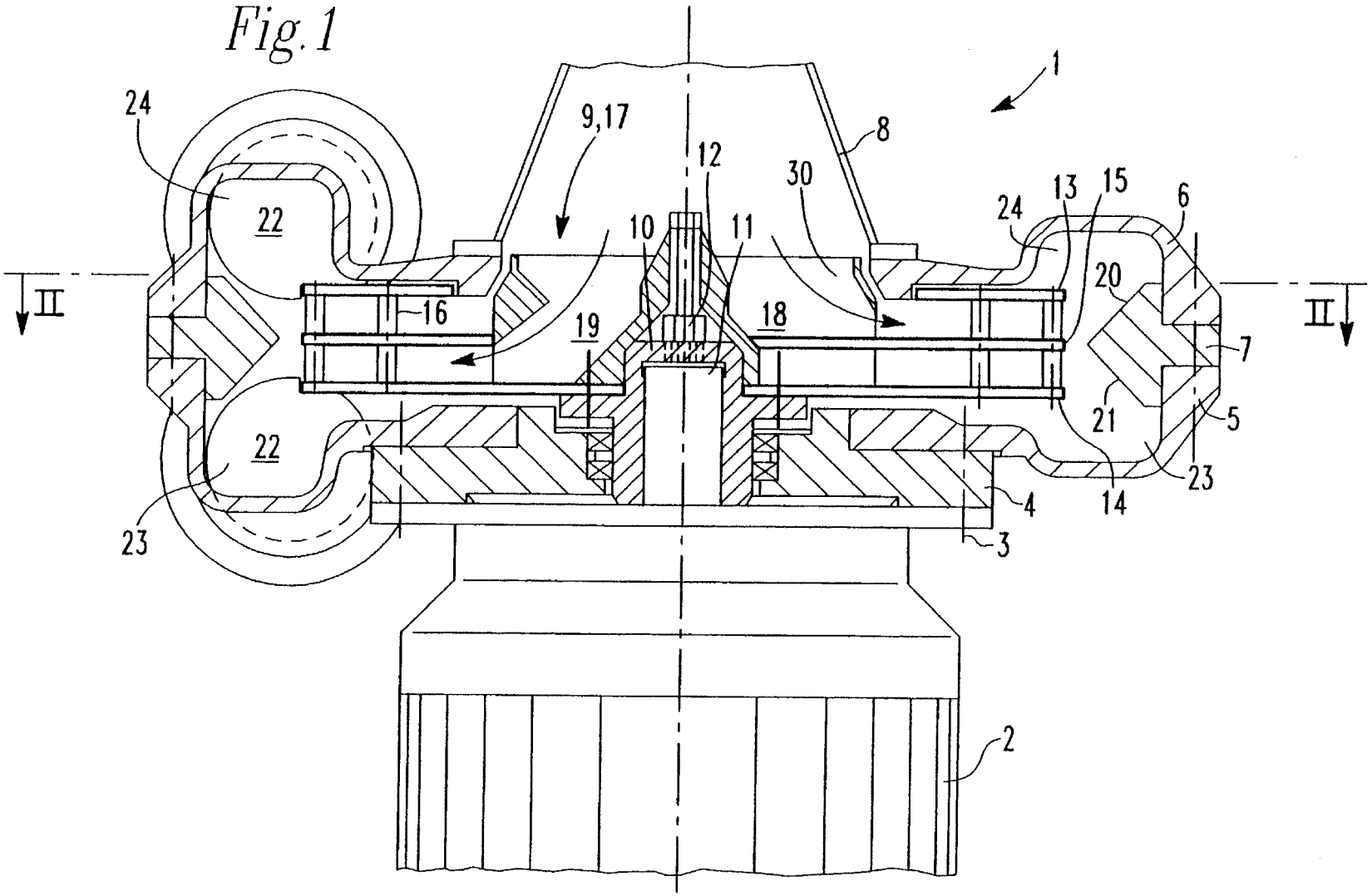
FIG. 1 shows a section in the axial direction through an impact detacher.

In the following, reference is made to FIG. 1. The upper part of the drawing shows an impact detacher 1 as a section in the axial direction. An approximately 3000 r.p.m. electric motor 2 (lower half of drawing) is securely screwed on to a lower stationary housing part 5 of the impact detacher 1 with screws 3 and a connecting flange 4. The connecting flange 4 is constructed in such a way that it receives the seals for the sealing of the impact detacher 1 externally. An upper housing part 6 is connected with the lower housing part 5 in such a way that an impact ring 7 is securely clamped between them. A feed pipe 8, through which the material to be treated is introduced into the impact detacher 1, is placed on the upper housing part 6 so as to be concentric to the two housing parts 5 and 6. A centrifugal wheel 9 is arranged in the housing parts 5 and 6. In so doing, it is arranged at the shaft 11 of the electric motor 2 via a supporting bushing 10 and a retaining screw 12. The centrifugal wheel or centrifugal rotor 9 is constructed by means of an outer rotating disk 13, an inner rotating disk 14 and a dividing ring 15 arranged in the middle between the two rotating disks 13, 14, combined by pins 16 to form a double wheel or double rotor 17. In so doing, an outer centrifugal conduit 18 close to the feed pipe 8 and an inner centrifugal conduit 19 remote of the feed pipe 8 are formed. The impact ring 7 comprises two oppositely directed impact surfaces 20, 21 which form two truncated cones opening into opposite directions, wherein the outer impact surface 20 is assigned to the outer centrifugal conduit 18 and the inner impact surface 21 is assigned to the inner centrifugal conduit 19.

Figure 2:
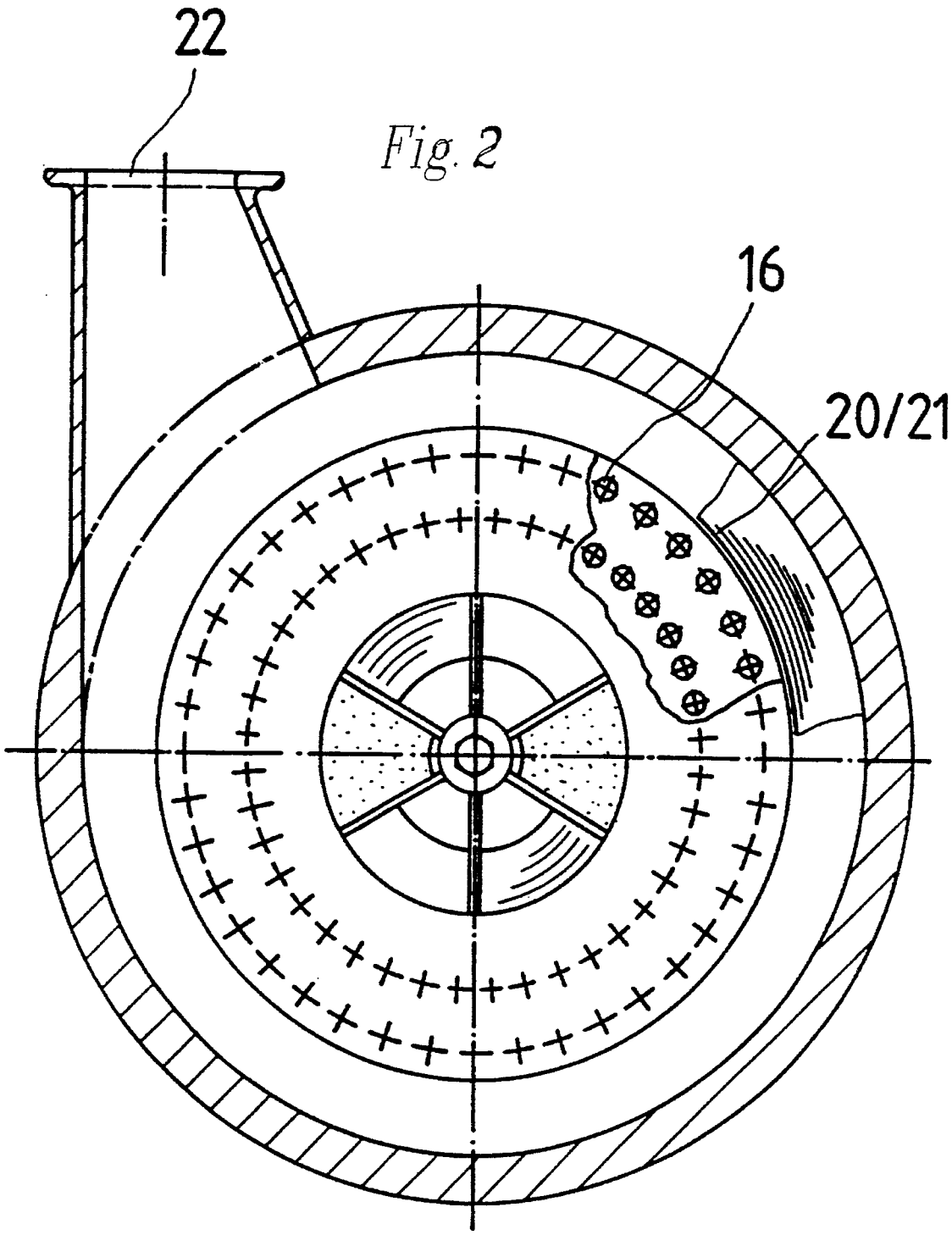
FIG. 2 shows a section II—II of FIG. 1.

A ventilator type product discharge conduit 23 and 24, respectively, which widens in the direction of the product discharge outlet 22 (FIG. 2), is arranged in the circumferential direction relative to the centrifugal wheel 9 and double wheel 17.

Figure 3:
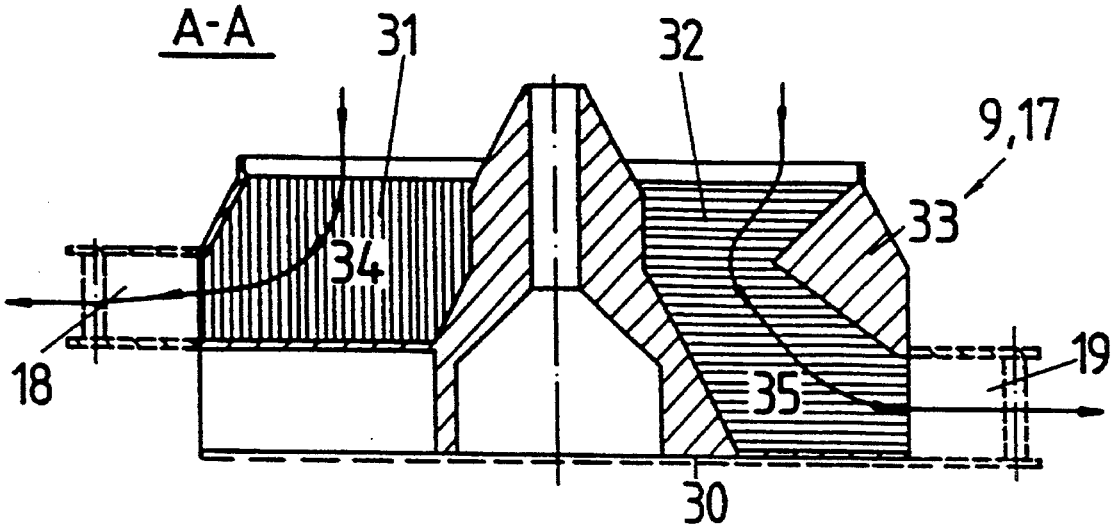
FIG. 3 shows the guiding apparatus of a double wheel.
Figure 4:
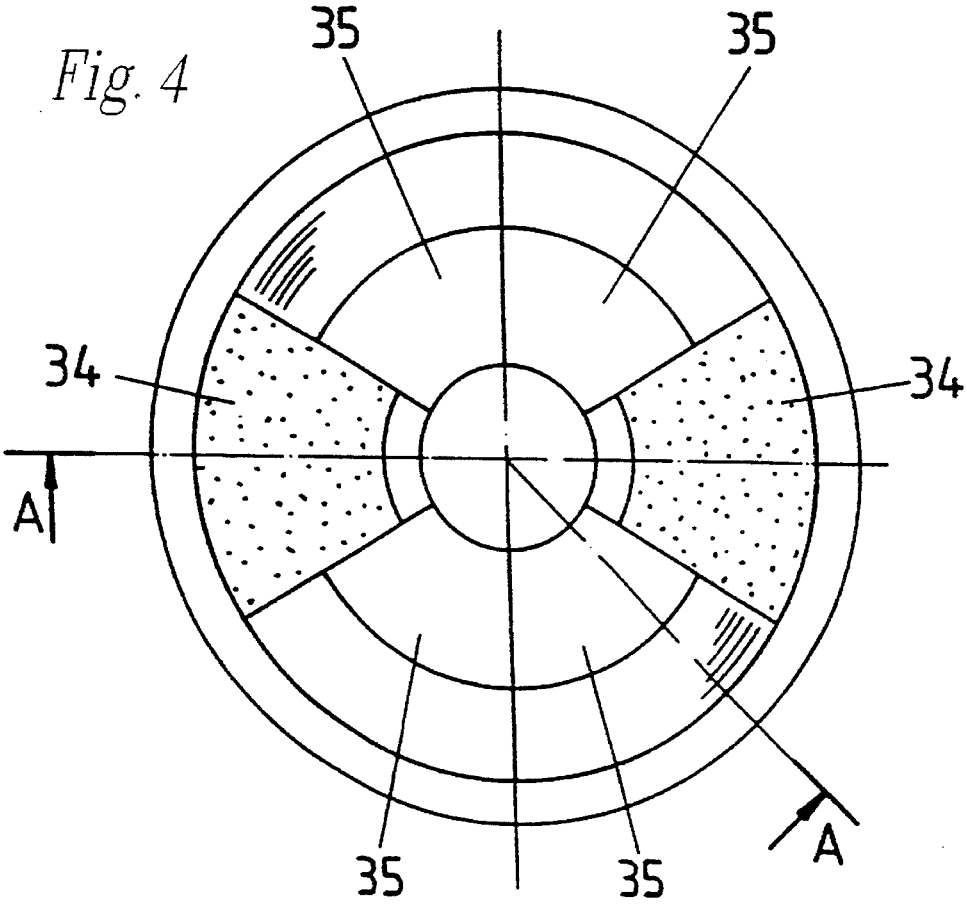
FIG. 4 shows an outline of FIG. 3.

The guiding apparatus 30 is shown by itself in Figures 3 and 4. The guiding apparatus 30 comprises two types of flat guide plates: short guide plates 31 which guide the product air flow into the outer centrifugal conduit 18 (close to the feed pipe 8) and long guide plates 32 which guide the product air flow into the inner centrifugal conduit 19 (remote of the feed pipe 8). The short guide plate 31 is provided in FIG. 3 with vertical hatching and the long guide plate 32 with horizontal hatching.

As can be seen from FIG. 3, the guiding apparatus 30 is produced in one piece, e.g. by means of casting, and the centrifugal conduits 18 and 19 are produced from sheet steel and both parts are connected to form a unit.

The centrifugal conduit 19 is also completely self-cleaning if an installation 33 in the form of an annular portion is arranged in the latter in the feed area of the centrifugal conduit 19 (hatched with circular rings in FIG. 4). The double rotor 17 has shown a ratio of 2:4 with respect to the number of outer feed conduits 34 to feed conduits 35. It was possible to prove in tests that virtually identical product flows are produced with this construction, which is likewise a confirmation of the positive effect of the new invention. The product/air mixture to be processed passes via the feed pipe 8 directly into the feed conduits 34 and 35, respectively, of the guiding apparatus 30 and is set in rotation. The mixture is accelerated in the feed conduits 34 and 35, respectively, and undergoes a first impact at the pins 16. This impacting effect is even doubled as a result of the use of two annularly arranged sets of pins 16. But another advantage of the large number of pins 16 consists in a uniform distribution of the mixture in the circumferential direction. In addition, it provides a certain shoveling effect. The product/air mixture is then thrown against its own impact surfaces 20 and 21, respectively, separately from the two centrifugal conduits 18 and 19, respectively. It can easily be seen that an immediate separation of the mixture occurs because of the 90° deflection for both flows in the opposite direction in each instance, the heavy product impacts on the provided impact surface and the air passes over it. As a result of the annular and substantially symmetrical arrangement of the two product discharge conduits 23 and 24, a stable air flow is formed in addition to a stable product flow, even after the impacting. The water turbine-type product discharge outlet 22 which widens in the circumferential direction reinforces a uniform action on the impact surface 20 and 21, respectively, and supports a recombining of the air and product which can be further transported as a mixture so as to be conveyed pneumatically after the product discharge outlet 22.

Various installation arrangements are shown in FIGS. 5 to 8. This shows that the working effect of the impact detacher 1 is always ensured independently of the installation position.

Figure 5:
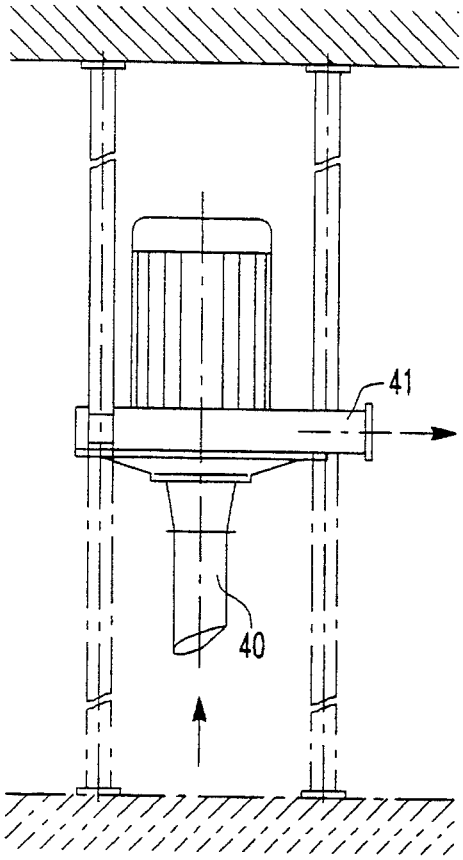
FIGS. 5 to 8 show various installation possibilities of the impact detacher.
Figure 6:
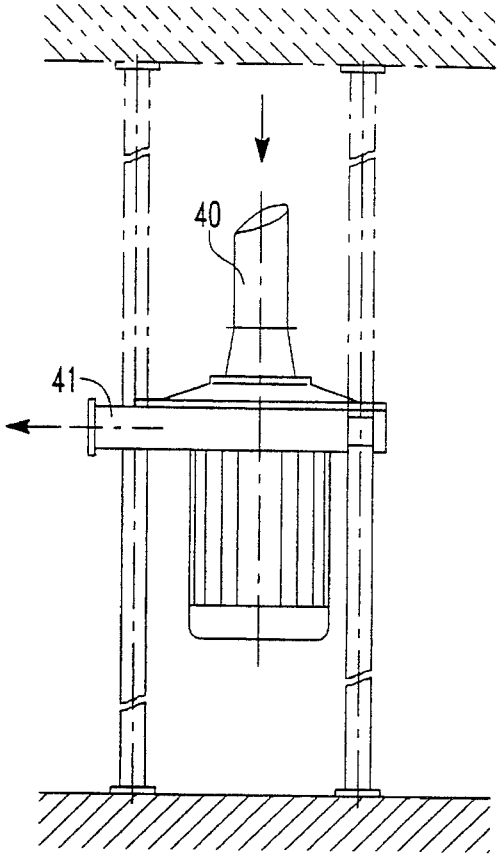
Figure 7:
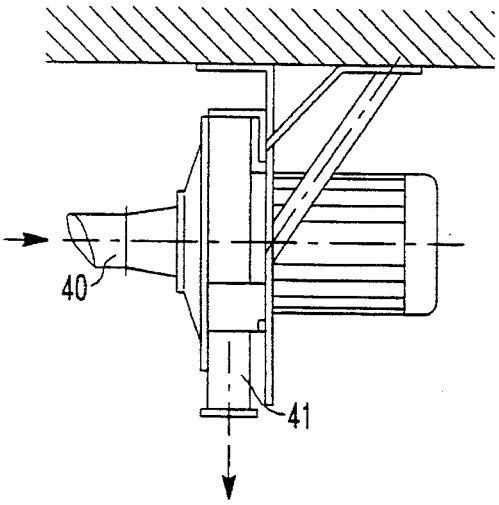
Figure 8:
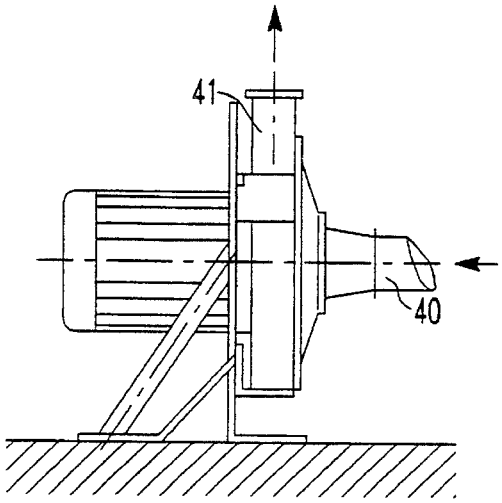

In FIG. 5 the product to be processed is fed into the impact detacher 1 vertically from below and guided away horizontally, in FIG. 6 the product feed is effected vertically from the top. On the other hand, the raw product enters the impact detacher 1 horizontally in FIGS. 7 and 8. The product transfer is effected vertically from below in FIG. 7 and vertically from the top in FIG. 8.

Figure 9:
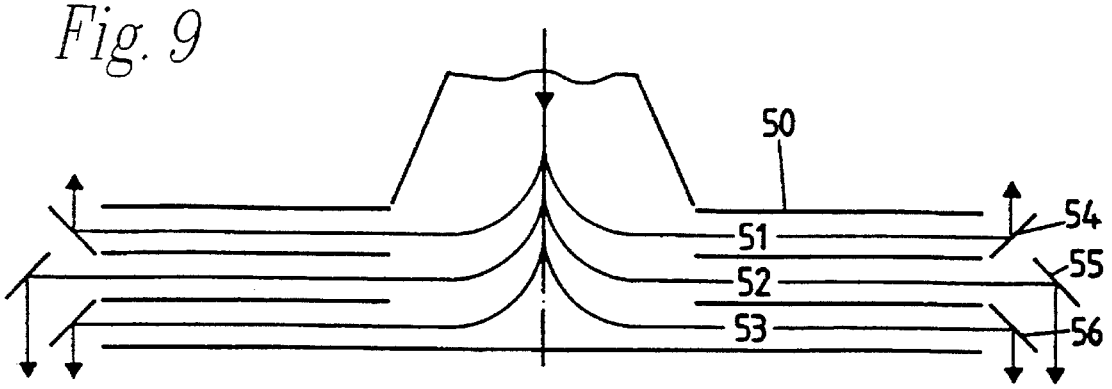
FIG. 9 shows a further embodiment example with a triple centrifugal rotor.

FIG. 9 shows another embodiment example with a triple centrifugal rotor 9, wherein every centrifugal conduit 51, 52, 53, respectively, comprises its own impact surface 54, 55, 56, respectively. The product flow is guided downward from the two impact surfaces 55 and 56 and is guided upward from the impact surface 54. It is also important here that the guiding apparatus 30 be constructed according to the same rules as in FIGS. 1 to 4 and that a uniform product distribution be ensured for all conduits.

Figure 10:
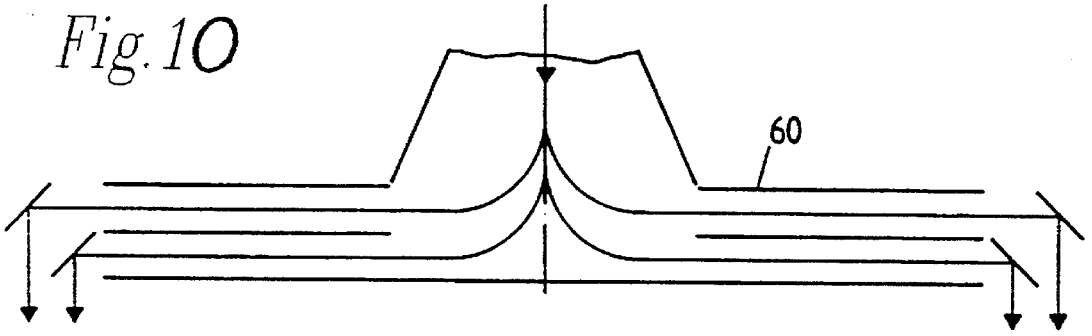
FIG. 10 shows another embodiment example in which the centrifugal rotor is constructed as a double rotor.

In FIG. 10, the centrifugal rotor is constructed as a double rotor similar to FIGS. 1 to 4, but with two impact surfaces 61 and 62, respectively, which guide the product flow downward in the same direction.

Figure 11:
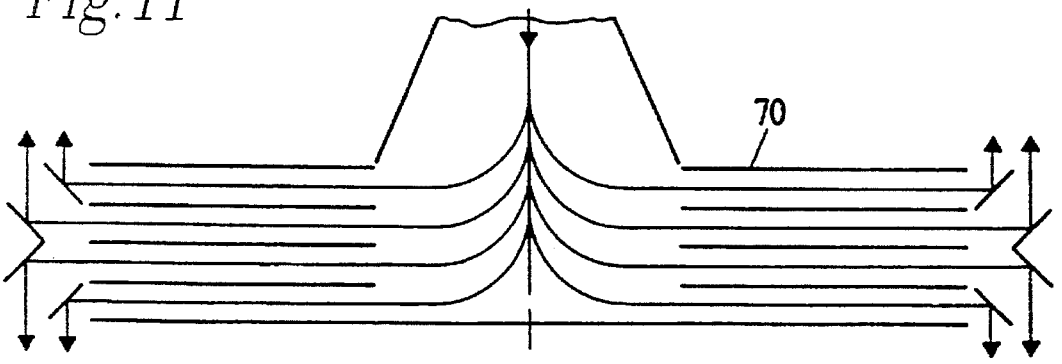
FIG. 11 shows a doubling of FIG. 10 with product guidance.

FIG. 11 shows a doubling of FIG. 10, but with product guidance in the two opposite directions, wherein the centrifugal rotor 70 is constructed as a four-fold rotor.

While the foregoing description and drawings represent the preferred embodiments of the present invention, it will be obvious to those skilled in the art that various changes and modifications may be made therein without departing from the true spirit and scope of the present invention.

What is claimed is:

1. An impact detacher for grain-like materials comprising:

a centrifugal wheel which rotates about an axis;

the wheel being enclosed within a housing; said housing having an annular impact ring;

a concentric feed pipe for feeding materials to the wheel;

said centrifugal wheel having a plurality of axially offset centrifugal conduits for the passage of the materials fed to the centrifugal wheel;

a guiding apparatus being arranged within the centrifugal wheel for delivering the material to the plurality of axially offset centrifugal conduits;

said annular impact ring including means, having a truncated cone section with two impact surfaces formed by two truncated cones opening in opposite directions, for allowing material passing through two of the plurality of axially offset centrifugal conduits to strike a respective one of said impact surfaces and to change direction resulting in two oppositely directed material streams;

a product discharge conduit for receiving said material streams for discharging materials; and a product outlet being provided and associated with said discharge conduit, whereby product is discharged from the housing through said conduit and said product outlet.

2. The impact detacher of claim 1, wherein said guiding apparatus is connected with the centrifugal wheel.

3. The impact detacher of claim 1, wherein said guiding apparatus has a plurality of feed conduits which provide material to the centrifugal conduits, the centrifugal conduits being shaped like annular disks.

4. The impact detacher of claim 3, wherein the feed conduits open into the centrifugal conduit remote of the feed pipe and have an installation at the outer circumference, the installation narrowing in cross-section.

5. The impact detacher of claim 4, wherein the installation is arranged in the feed of the guiding apparatus and is constructed as an annular portion with a tapered shape toward the axis of rotation.

6. The impact detacher of claim 3, wherein the feed conduits are identical to one another and arranged symmetrically.

7. The impact detacher of claim 3, wherein the ratio of feed conduits delivering material to the inner conduit to the feed conduits delivering material to the outer conduit is about 1:2.

8. The impact detacher of claim 1, wherein said guiding apparatus comprises flat guide blades for delivering the material to the centrifugal conduits.

9. The impact detacher of claim 1, wherein an electric motor is flanged onto the housing of the impact detacher to effect rotation of the wheel.

10. The impact detacher of claim 1, wherein said product discharge conduit is formed from two halves having approximately the same shape, the discharge conduit being divided into two halves along a plane perpendicular to the axis of rotation of the wheel.

11. The impact detacher of claim 1, the impact detacher constructed having ventilation so that material feed and material discharge can be selected within a vertical plane as well as in a horizontal plane in all spatial directions.

12. The impact detacher of claim 1, wherein the change in direction is approximately 90 degrees.

13. The impact detacher of claim 1, wherein the impact ring substantially divides the housing into inner and outer cavities for the delivery of the impacted material to said product discharge conduit which further comprises inner and outer discharge conduit portions positioned tangentially to the wheel.

14. The impact detacher of claim 1 further wherein the product discharge conduit is an annular product discharge conduit.

15. The impact detacher of claim 14 wherein the product outlet is a tangential common product outlet.

16. The impact detacher of claim 1, wherein the housing has a second annular impact ring including means, having a truncated cone section with an impact surface formed by a truncated cone opening in one of the opposite directions, for allowing material passing through another one of the plurality of axially offset centrifugal conduits to strike the impact surface of the second impact ring and to change direction.

17. An impact detacher for grain-like materials comprising:

a centrifugal wheel which rotates about an axis;

the wheel being enclosed within a housing, said housing having a plurality of annular impact rings;

a concentric feed pipe for feeding materials to the wheel;

said centrifugal wheel having a plurality of axially offset centrifugal conduits for the passage of the materials fed to the centrifugal wheel;

a guiding apparatus being arranged within the centrifugal wheel for delivering the material to the plurality of axially offset centrifugal conduits;

each one of said plurality of annular impact rings including means, having at least one truncated cone section with at least one impact surface, for allowing material passing through a respective one of the plurality of axially offset centrifugal conduits to strike a corresponding impact surface and to change direction, said plurality of impact rings being configured such that their impact surfaces direct the impacted material in two opposite directions, a product discharge conduit for receiving said material streams for discharging materials; and a product outlet being provided and associated with said discharge conduit, whereby product is discharged from the housing through said conduit and said product outlet.

* * * * *

UNITED STATES PATENT AND TRADEMARK OFFICE

CERTIFICATE OF CORRECTION

PATENT NO. : 5,474,238

DATED : December 12, 1995

INVENTOR(S) : Franz Reichmuth

It is certified that error appears in the above-identified patent and that said Letters Patent is hereby corrected as shown below:

Claim 10, column 6, line 33, "claim 1" should read --claim 15--.

Claim 13, column 6, line 44, "claim 1" should read --claim 14--.

Signed and Sealed this

Twelfth Day of March, 1996

Bruce Lehman

*Attest:*

BRUCE LEHMAN

*Attesting Officer*

*Commissioner of Patents and Trademarks*